US010939741B2

(12) United States Patent
Chen et al.

(10) Patent No.: US 10,939,741 B2
(45) Date of Patent: Mar. 9, 2021

(54) PACKAGING FOR COSMETICS

(71) Applicants: MYC Packaging Innovation Co., Limited, Jiangsu (CN); TOMIA BEAUTY BRANDS LLC, New York, NY (US)

(72) Inventors: Wensheng Chen, Jiangsu (CN); Jack Bensanson, New York, NY (US)

(73) Assignees: MYC Packaging Innovation Co., Limited, Jiangsu (CN); TOMIA BEAUTY BRANDS LLC, New York, NY (US)

( * ) Notice: Subject to any disclaimer, the term of this patent is extended or adjusted under 35 U.S.C. 154(b) by 280 days.

(21) Appl. No.: 15/894,562

(22) Filed: Feb. 12, 2018

(65) Prior Publication Data

US 2018/0235346 A1 Aug. 23, 2018

(30) Foreign Application Priority Data

Feb. 17, 2017 (IT) ..... 102017000018198

(51) Int. Cl.

| | |
|---|---|
| ***A45D 34/04*** | (2006.01) |
| ***A45D 2/48*** | (2006.01) |
| ***A45D 40/26*** | (2006.01) |
| ***A45D 40/28*** | (2006.01) |
| ***A46B 9/02*** | (2006.01) |
| *A45D 40/18* | (2006.01) |

(52) U.S. Cl.

CPC ..... *A45D 34/045* (2013.01); *A45D 2/48* (2013.01); *A45D 40/265* (2013.01); *A45D 40/28* (2013.01); *A46B 9/02* (2013.01); *A45D 40/18* (2013.01)

(58) Field of Classification Search

CPC ..... A45D 2/48; A45D 34/042; A45D 34/043; A45D 34/046; A45D 40/18; A45D 40/24; A45D 40/262; A45D 40/264; A45D 40/265; A45D 29/02; A45D 2029/026

USPC ..... 132/216, 217, 218, 314

See application file for complete search history.

(56) References Cited

U.S. PATENT DOCUMENTS

| | | | | |
|---|---|---|---|---|
| 2,314,376 A | | 3/1943 | Tuttle et al. | |
| 2,893,404 A | * | 7/1959 | Flynn | A45D 2/48 132/217 |
| 5,598,858 A | * | 2/1997 | Wainer | A45D 2/48 132/216 |
| 6,220,252 B1 | * | 4/2001 | Heintz | A45D 2/48 132/216 |

(Continued)

FOREIGN PATENT DOCUMENTS

WO 2007/114544 A1 10/2007

OTHER PUBLICATIONS

WikiHowtoCurlYourEyelashes (http://web.archive.org/web/20170216011617/https://www.wikihow.com/Curl-Your-Eyelashes); Feb. 16, 2017.*

*Primary Examiner* — Cris L. Rodriguez
*Assistant Examiner* — Brianne E Kalach
(74) *Attorney, Agent, or Firm* — Vorys, Safer, Seymour and Pease LLP

(57) ABSTRACT

Provided is a packaging for cosmetics is provided defining a longitudinal axis and a normal plane perpendicular to the longitudinal axis. The package includes a first container body, a second container body, a central body including a base and an applicator, in which the first container body is couplable to the second container body.

10 Claims, 4 Drawing Sheets

(56) References Cited

U.S. PATENT DOCUMENTS

| | | | | |
|---|---|---|---|---|
| 8,043,017 | B2 * | 10/2011 | Beierwaltes | A45D 40/24 132/294 |
| 2004/0020505 | A1 * | 2/2004 | Sugiyama | A45D 2/48 132/217 |
| 2004/0020506 | A1 * | 2/2004 | Sugiyama | A45D 2/48 132/217 |
| 2005/0150509 | A1 | 7/2005 | Gueret | |
| 2008/0006287 | A1 * | 1/2008 | Gueret | A45D 40/265 132/218 |
| 2009/0211939 | A1 * | 8/2009 | Cho | A45D 26/0066 206/581 |
| 2011/0020046 | A1 * | 1/2011 | Dumler | A45D 40/24 401/17 |
| 2013/0074865 | A1 * | 3/2013 | Santillan | A45D 2/48 132/217 |
| 2016/0183655 | A1 * | 6/2016 | Dozer | A45D 2/48 132/217 |

* cited by examiner

PACKAGING FOR COSMETICS

FIELD OF THE INVENTION

The present invention relates to a packaging for cosmetics defining a longitudinal axis and a normal plane perpendicular to the longitudinal axis comprising: a first container body, a second container body, a central body comprising a base and an applicator, the first container body being suitable to be coupled to the second container body, defining a closed configuration, defining an internal volume of the packaging, and an open configuration for the packaging, the central body being detachably fastened to and partially arranged within one of the container bodies and being also partially arranged inside the other of the container bodies when the packaging is in the closed configuration, the first container body comprising first fastening means and the second container body housing second fastening means, the fastening means being suitable to couple the first container body and the second container body.

DESCRIPTION OF THE PRIOR ART

In particular, the present invention relates to a device used for containing and, preferably, applying a cosmetic product. This cosmetic product may be a mascara, a blush, a lip gloss, a lipstick, an eyeliner, a kajal, an eyeshadow, a gloss, a foundation, a concealer, a serum, a cream, a skin care product, an eye treatment or skin care.

As is known, packaging used for cosmetic products in liquid or cream state consists of a container housing the product and a cap that, in the closed configuration, can be engaged with the container by means of a fastener.

In particular, conventional cosmetic products in cream/liquid state have a container consisting of a main body on which the cosmetic product is arranged, a casing defining a container chamber of the main body and the cosmetic product. In addition, the commonly known casings can include kinematic means for the extraction and the use of the cosmetic product or may have, for example, applicators.

A similar cosmetic product is described in the patent application WO 2007/114544 A1.

More rarely it is possible to find multifunctional casings in the state of the art that provide in themselves functionality not exclusively dedicated to the application of the cosmetic.

The prior art described has some significant drawbacks.

In particular, casings for cosmetics of conventional design do not permit performance of other significant functions related for example to the beautification of the face or other.

These packagings are in fact solely intended for the use given by the application of the cosmetic and need, if they are required to provide additional functionality such as for example pairing with a lipstick-mirror, separate items that can make them undesirably bulky in dimensions for a user.

Another significant drawback arises from the fact that unconventional multifunctional cosmetics packagings almost always require increased dimensions.

As a consequence of the abovementioned, a further drawback arises from the fact that casings of the type considered above are not aesthetic and therefore constitute serious problems for a demanding market such as the make-up market.

Finally, another drawback arises from the fact that the containers commonly known in the state of the art, when in a multifunctional configuration, they incorporate within themselves other elements that require an increase, as stated, of the packaging dimensions and hence of the costs.

SUMMARY OF THE INVENTION

In these circumstances, the technical task underlying the present invention is to devise a packaging for cosmetics capable of substantially remedying the said drawbacks.

Within the scope of the said technical task a significant aim of the invention is to achieve a multifunctional packaging that encompasses in a single item a plurality of functionality.

Another significant objective of the invention is therefore to achieve a multifunctional packaging that ensures the total beautification of at least a part of the body without the need for auxiliary items or instruments which would lead to additional encumbrance for the user.

A further objective of the invention is to provide a cosmetic casing of the type previously presented defined by limited dimensions and appropriate for the market.

The technical task and the objectives specified are achieved by a packaging for cosmetics defining a longitudinal axis and a normal plane perpendicular to the longitudinal axis comprising: a first container body, a second container body, a central body comprising a base and an applicator, the first container body being suitable to be coupled to the second container body, defining a closed configuration, defining an internal volume of the packaging, and an open configuration for the packaging, the central body being detachably fastened to and partially arranged within one of the container bodies and being also partially arranged inside the other of the container bodies when the packaging is in the closed configuration, the first container body comprising first fastening means and the second container body housing second fastening means, the fastening means being suitable to couple the first container body and the second container body, the packaging comprising an auxiliary element, separated from the applicator, the auxiliary element including a first portion and a second portion, the portions defining between them at least one aperture, the aperture being suitable to accommodate eyelashes, the second portion being movably fastened to the first portion and suitable to reduce by its movement the size of the aperture, the portions being suitable to curl the eyelashes when the aperture is closed.

BRIEF DESCRIPTION OF THE DRAWINGS

The characteristics and advantages of the invention will be clarified in the following detailed descriptions of some preferred embodiments of the invention, with reference to the accompanying drawings, in which.

DESCRIPTION OF THE PREFERRED EMBODIMENTS

Figure 1:
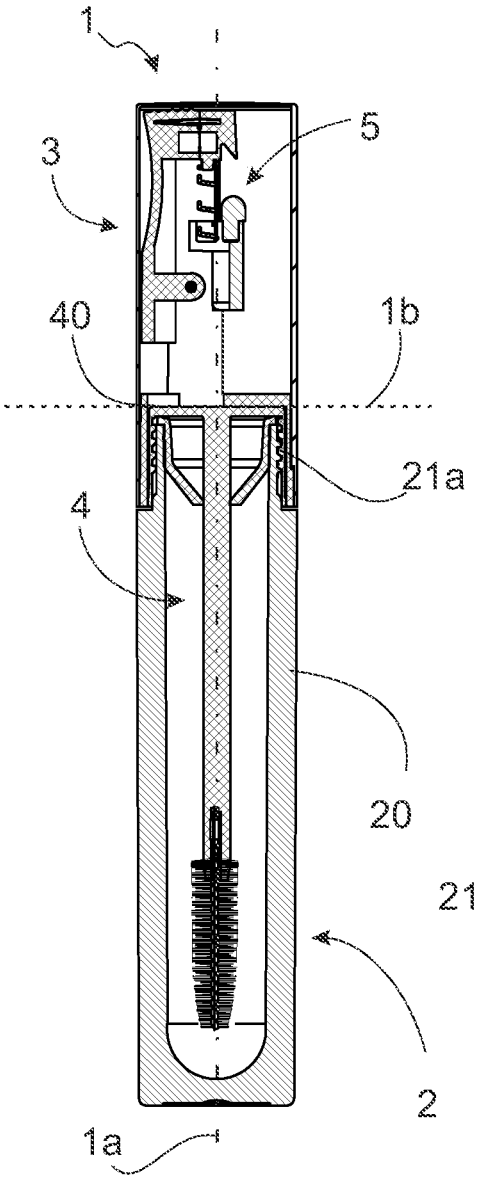
FIG. 1 shows a section of the packaging for cosmetics with the auxiliary element in the closed configuration.
Figure 2:
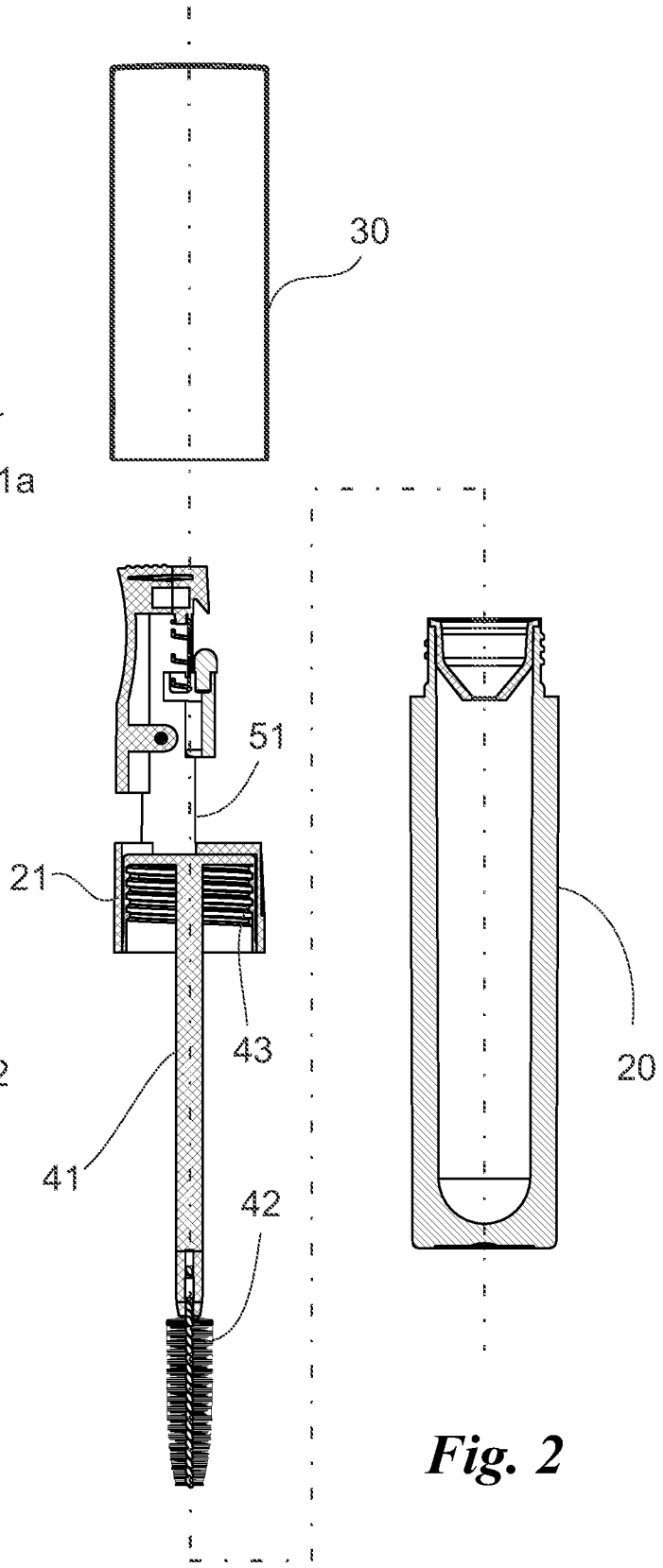
FIG. 2 illustrates a section of the packaging for cosmetics in the open configuration.
Figure 3:
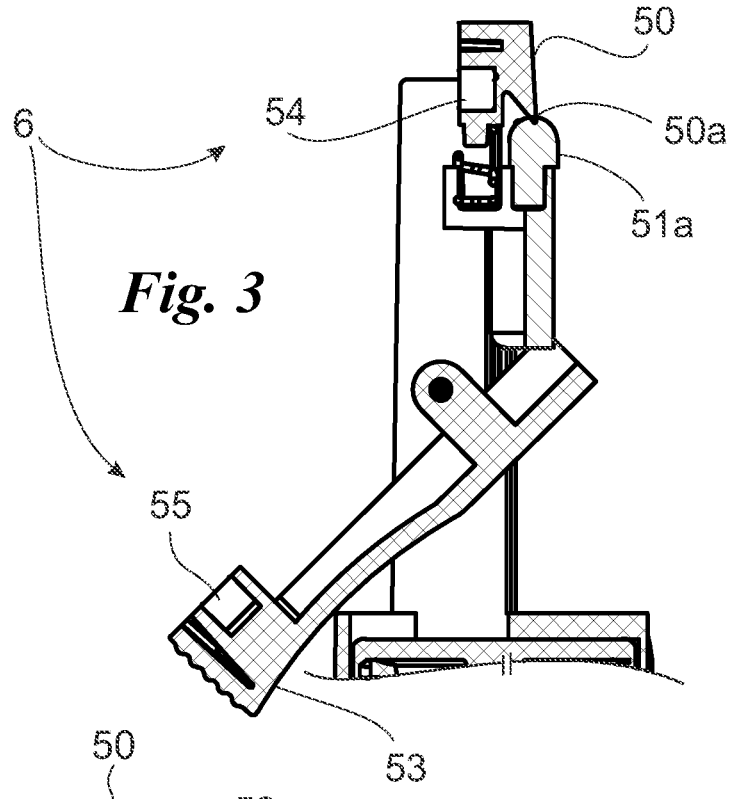
FIG. 3 shows the auxiliary element in details.
Figure 4:
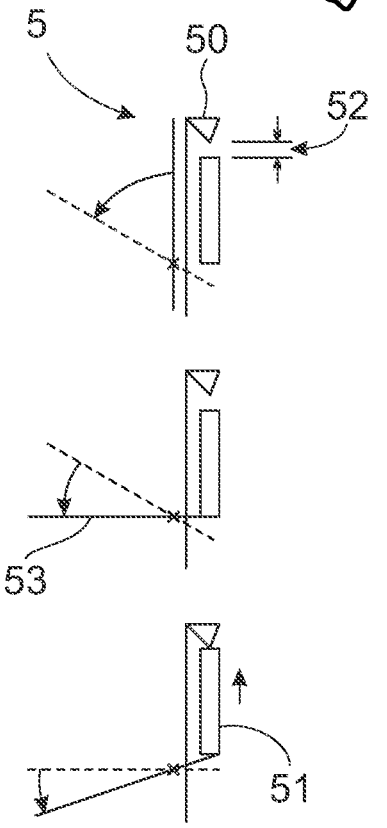
FIG. 4 is a diagram of the operation of the auxiliary element.
Figure 5:
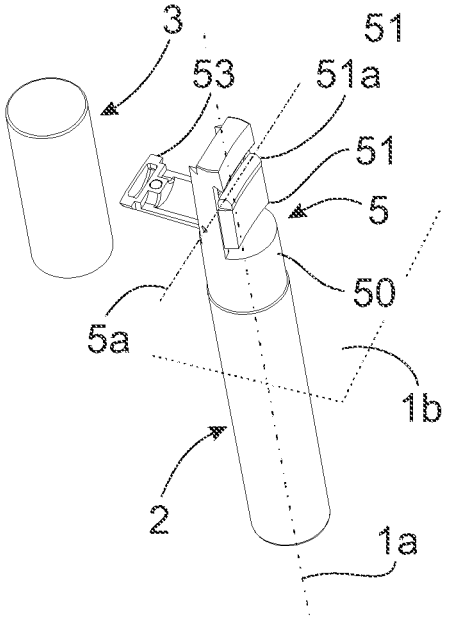
FIG. 5 is a perspective view of the packaging according to the invention.
Figure 6:
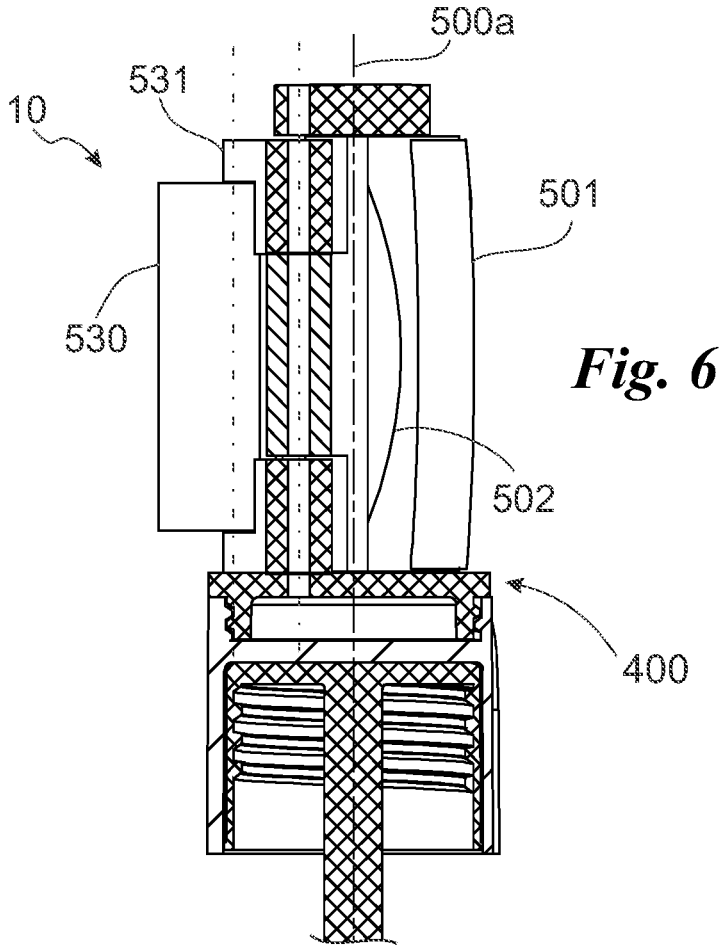
FIG. 6 shows a section of the packaging for cosmetics with the auxiliary element in an alternative configuration.
Figure 7:
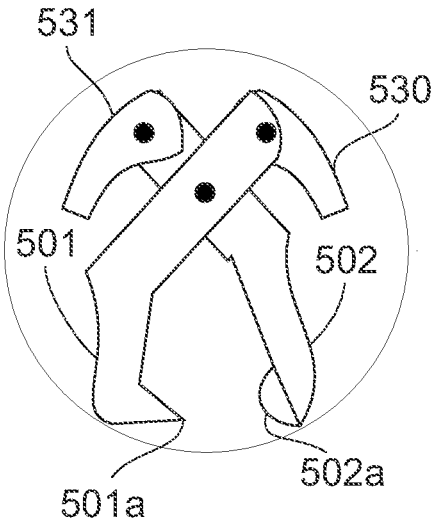
FIG. 7 illustrates a sectional top view of the packaging for cosmetics in an alternative configuration.
Figure 8:
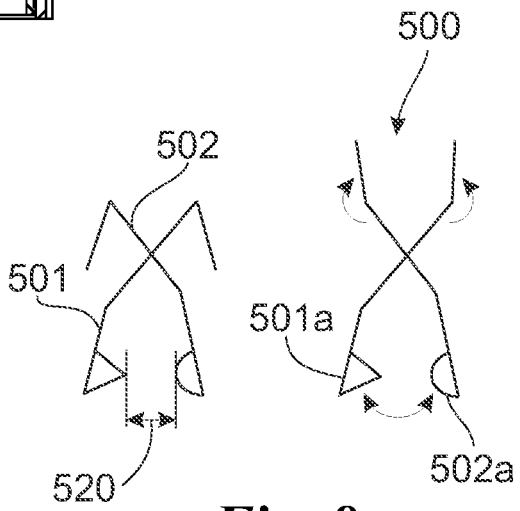
FIG. 8 shows a diagram of the operation of the auxiliary element in an alternative configuration.

In the present document, the measures, values, shapes and geometric references (such as perpendicularity and parallelism), when associated with words like "about" or other similar terms such as "almost" or "substantially", are to be understood as with the exception of any measurement errors or inaccuracies due to production and/or manufacturing defects and, especially, with the exception of a slight difference from the value of the measure, of the shape or of the geometric reference with which it is associated. For example, these terms, if associated with a value, preferably indicate a difference of not more than 10% of the value itself.

Furthermore, when used, terms such as "first", "second", "top", "bottom", "main" and "secondary" do not necessarily identify an order, a priority of relationship or relative position, but can simply be used to more clearly distinguish among different components.

With reference to the Figures, the packaging for cosmetics according to the invention is indicated overall with the number 1.

The packaging 1 defines a longitudinal axis 1*a* and a normal plane 1*b* perpendicular to the longitudinal axis 1*a*.

Furthermore, the packaging for cosmetics 1 comprises a first container body 2, a second container body 3, a central body 4, an auxiliary element 5 and tightening means 6.

The first container body 2 preferably consists of two main components. These components are a reservoir 20 and a connecting element 21.

The reservoir 20 is for example a cylindrical container centred on the longitudinal axis 1*a*, although it may take different forms, of variable dimensions within which it is possible to place a cosmetic product.

Therefore the reservoir 20 consists of, for example, a closed end and an open end. The latter is for example suitable to comprise the connecting element 21.

The reservoir 20 can also be made of glass or metal material and preferably it is made of polymeric material with for example transparent surfaces.

However, the nature of the preferably polymeric material enables for example different colourings.

The connecting element 21 is for example a substantially annular element arranged at the reservoir opening and comprises for example a narrowing section in relation to the reservoir 20.

In addition, the connecting element 21 preferably comprises first fastening means 21*a* on its outer surface.

These first fastening means 21*a* may consist of a helical guide, extending around the longitudinal axis 1*a*, positioned at the opening of the reservoir 20 or other means suitable to detachably fasten an item to the connecting element 21.

The fastening means 21*a* preferably consist of at least one abutment formed on the outer surface of the connecting element 21.

Therefore the first fastening means 21*a* for example project toward the outside of the first container body 2.

Therefore the first container body 2 is for example a cylinder comprising a stepped narrowing section on its top, but it may also have different shapes, for example squared or comprising edges.

The first container body 2 is also preferably coupled to said second container body 3, for example at the top of the reservoir 20.

The second container 3 is therefore preferably a container, for example of cylindrical shape and centred on the longitudinal axis 1*a*, comprising a closed end and an open end.

The second container body 3 also comprises a cover 30.

The cover is for example a removable lid defining the outer surface of the second container body 3 and is suitable, when removed, to make what is included within the second container body 3 emerge.

As for the first container body 2, the second container body 3 may have a shape that is squared or other for example comprising edges.

The open end of the second container body 3 is then preferably suitable to completely cover the area described by the section of the reservoir 20, but may alternatively comprise means for connecting to the housing of the connecting element 21.

The first container body 2 and the second container body 3 can therefore be coupled in such a manner as to define a closed configuration defining an internal volume 10.

The internal volume 10 is therefore the space delimited by the walls of the first container body 2 and of the second container body 3.

When in the closed configuration, the container bodies 2, 3 preferably contain internally, and therefore within the volume 10, the central body 4.

The central body 4 is preferably detachably fastened to at least one of the container bodies 2, 3.

The central body 4 and the container bodies 2, 3 may therefore comprise releasable fastening means by for example interlocking or threaded couplings which allow both the coupling and decoupling of the central body 4 and of the container bodies 2, 3.

In detail, the central body 4 consists of for example a cosmetic applicator of variable shapes and sizes.

The central body 4 preferably comprises for example a base 40, a stem 41 and an applicator 42.

The base 40 is preferably suitable to be adherently fastened with at least a portion of the inner surface of at least one of the container bodies 2, 3 and preferably a portion of the inner surface of the second container body 3.

It may then be fastened to the second container body 3 by means of adhesive substances or interlocking or by means of mechanical joints provided that the central body 4 is preferably detachably fastened to the second container body 3. The base 40 preferably further comprises second fastening means 43 arranged on the inner surface suitable to be releasably coupled with the connecting element 21.

These second fastening means 43 are therefore substantially abutments arranged for example on the base 40 or adjacent thereto that can be coupled to the abutments present on the first fastening means 21*a* of the connecting element 21. The stem 41 is for example a polymeric stem centred on the longitudinal axis 1*a* and fastened to the base 40. It extends from the base toward the open end of the cap 3 and is suitable to be inserted inside the opening defined by the connecting element 21 included in the container body 2.

Therefore, the stem 41 preferably has dimensions such as to ensure the correct closure and adhesion between the container bodies 2, 3. Furthermore, the length of the stem 41 is preferably such as to allow the applicator 42 to be placed in the vicinity of the closed end of the reservoir 20, or alternatively of the second container body 3, when the first container body 2 and the second container body 3 are mutually coupled i.e. in closed configuration. The stem 41 preferably has a circular perpendicular cross section or even a non-circular cross section, for example of the oval or semi-circle or other type.

Finally the applicator 42 is for example a soft medium, or a bristled element or a sponge element insofar as it is suitable to receive, hold and distribute on contact a cosmetic product.

In particular, the applicator 42 is preferably fastened to the free end of the stem 41.

The second container body 3 preferably comprising the central body 4 is also preferably suitable, when coupled with the first container body 2, to contain entirely within itself the first fastening means 21*a* of the connecting element 21.

In addition, the central opening of the connecting element 21 is preferably such as to ensure the inclusion of at least part of the central body 4 and in particular for example of the brush 42 and of the stem 41.

The inner walls of the opening of the connecting element 21 are preferably spaced from the stem 41 when the second container body 3 and the first container body 2 are coupled in the closed configuration.

The auxiliary element 5 is preferably included, or better includible, within the volume 10 defined by the container bodies 2, 3, more preferably within the volume defined by the second container body 3. The auxiliary element 5 is moreover separated, in particular functionally separated, from the applicator 42, so that it can work independently from the same applicator 42.

In particular, the auxiliary element 5 is preferably fastened to the base 40 of the central body 4.

In an alternative configuration, however, the auxiliary element 5 can be arranged on the outside of the volume 10 and may be adjacent to and fastened or movably fastened to one of the container bodies 2, 3.

The auxiliary element 5 also defines a secondary axis 5*a* parallel to the main plane 1*b* and comprises for example a first portion 50 and a second portion 51.

In particular, the first portion 50 and the second portion 51 define at least one aperture 52.

This aperture is a space or volume or slot provided between the portions 50, 51. The aperture 52 also has a preferably rectangular tapered shape and is suitable to accommodate the eyelashes of a user.

The second portion 51 is then preferably movably fastened to the first portion 50. In particular, the first portion 50 is for example a fixed portion that is fastened to the base 40, or it may coincide with the base 40 of the central body 4.

Alternatively, the first portion 50 may also be movable and, therefore, movably fastened to the base 40.

Preferably, the first portion 50 is fastened to the base 40 in such a way as to contain the second fastening means 43. Furthermore, the first portion 50 is for example included within the second container body 3 and separates the cover 30 of the container body 3 from the second fastening means 43.

In detail, the cover 30 is preferably releasably fastened to the first portion 50 of the auxiliary element 5, the auxiliary element 5 is preferably fastened to the base 40 of the central body 4 and the central body 4 is detachably fastened to the connecting element 21 of the first container body 2. In the closed configuration, the second container body 3 therefore preferably contains the second fastening means 43. Furthermore, the first portion 50 is for example a rigid body comprising at least a through opening or cavity or window in its interior, in such a way as to accommodate therein external bodies such as eyelashes.

Indeed, the auxiliary element 5 is preferably substantially an eyelashes curler. The opening or cavity or window may also provide fastening means to the sides. These fastening means may for example be tracks oriented along the longitudinal axis 2*a* and suitable to direct a slider fastened thereto.

These fastening means may therefore be guides comprising protuberances or grooves or other preferably suitable to house at least part of the second portion 51.

These fastening means can therefore also comprise elastic return elements such as springs or magnets, for example with reverse polarity, to allow the second portion 51 to return to its initial position as a result of a controlled translation along the tracks.

In addition, the first portion 50 preferably comprises a tooth 50*a* extending for example along said longitudinal axis la inside the cavity and in particular the aperture 52 defined by the portions 50, 51.

The second portion 51 is preferably a slider that is suitable to translate along the longitudinal axis 1*a* with respect to said first portion 50. The second portion 51 is therefore a body suitable to be movably fastened onto the fastening means or tracks enclosed in the cavity of the first portion 50 and may have different shapes or dimensions compatible with the aforesaid cavity.

The second portion 51 preferably comprises a contact part 51*a*. This contact part 51*a* extends substantially parallel to the normal plane 1*b* and faces inwards towards the tooth 50*a* and projecting within the aperture 52.

This contact part 51*a* is therefore preferably suitable to adhere to the tooth 50*a* when the slider is moved toward the aforesaid tooth 50*a*.

The auxiliary element therefore defines an open configuration when the contact part 51*a* is far away from the tooth 50*a* and a closed configuration when the tooth 50*a* adheres to the said contact part 51*a*.

When the auxiliary element 5 is in the closed configuration the aperture 52 is closed.

The second portion 51 is therefore suitable to reduce by its movement the size of the said aperture 52.

In greater detail, the portions 50, 51 are suitable to curl the eyelashes of a user when the aperture 52 is closed.

The contact part 51*a* is preferably formed of material having a lesser hardness with respect to the tooth 50*a* and in particular is made of silicone material, while the tooth 50*a* can be plastic or polymeric material having a hardness greater than that of the silicone material.

The auxiliary element 5 also preferably comprises a secondary movable portion 53.

The secondary movable portion 53 is movably fastened to the first portion 50 and is in particular suitable to control the movement of the second portion 51.

However, the cosmetic casing 1 could be devoid of the secondary movable portion 53 and the second portion 51 could be moved through friction by a user, for example by controlling the translation of the second portion 51 through friction and, preferably, with a finger.

The secondary movable portion 53 is preferably movably fastened to the first portion 50 by means of hinges substantially aligned with the secondary axis 5*a*.

The secondary movable portion 53 is therefore a class 1 lever or bar suitable to rotate around the secondary axis 5*a*.

The secondary movable portion 53 is preferably movable from an initial position in which it is for example aligned with the longitudinal axis 2*a* and with the fixed part 50 to a final position in which, by rotating, it pushes the second portion 51 toward the tooth 50*a* of the first portion 50.

In order to encourage the return to the initial position of the secondary movable portion 53, the first portion 50 comprises a first tightening element 54 and the secondary movable portion 53 comprises a second tightening element 55.

The tightening elements 54, 55 are in particular suitable to detachably fasten at least part of the first portion 50 and at least part of the secondary movable portion 53.

The tightening elements 54, 55 can therefore be releasable interlocking elements, or may be uncouplable adhesive surfaces.

The tightening elements 54, 55 are preferably magnetic elements and therefore at least one of the tightening elements 54, 55 is a magnet and the other is ferromagnetic.

The auxiliary element 5, lastly, is for example closable by means of one of the container bodies 2, 3 and the auxiliary element 5 can preferably be covered with the second container body 3, when the container body 3 becomes fastened to the central body 4 and mainly to the base 40.

In an alternative configuration, the cosmetic casing 10 has substantially the same features as the cosmetic casing 1.

However, the cover 3 is preferably detachably or releasably fastened directly to the central body 400 and the first portion 501 of the auxiliary element 500 is transiently fastened to the central body 400.

The central body 400 may therefore be in one piece or may comprise two releasably fastenable portions that can then allow for the separation of the auxiliary element 500 from the rest of the central body 400.

In particular, the auxiliary element 500 also defines a secondary axis 500*a* parallel to the main axis 1*a*, when the casing 10 is in the closed configuration, and comprises the first portion 501 and a second movable portion 502.

In particular, the first portion 501 and the second portion 502 define at least one aperture 520.

This aperture is a space or volume or slot provided between the portions 501, 502. The aperture 520 also has a preferably rectangular tapered shape and is suitable to accommodate the eyelashes of a user.

The second portion 502 is then preferably movably fastened to the first portion 501. In particular, the first portion 501 and the second portion 502 define a substantially scissors-like structure.

Therefore, the first portion 501 and second portion 502 are preferably fastened substantially in a central position in such a way as to allow for the mutual rotation of both portions 501, 502 about an axis parallel to the secondary axis 500*a*.

Furthermore, the portion 501 and the second portion 502 may for example be connected by means of an elastic element, preferably a torsional spring, so as to allow the first portion 501 and second portion 502 to maintain, at rest, an open scissors-like configuration.

Also the first portion 501 preferably comprises a tooth 501*a* extending for example transversely with respect to the secondary axis 500*a* and protruding toward the aperture 520 defined by portions 501,502.

Figure 9:
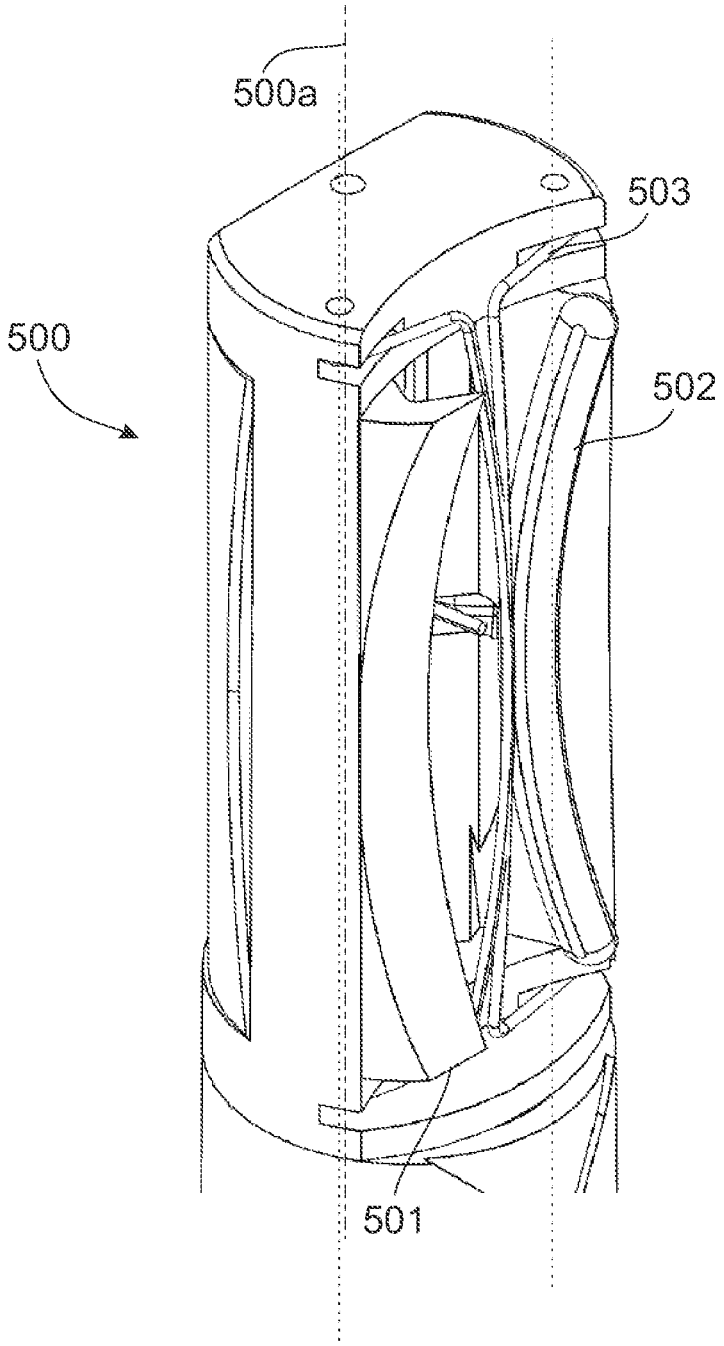
FIG. 9 is a perspective view of the auxiliary element in the alternative configuration.

The tooth 501*a* may have at least a curvature on its surface, as shown in FIG. 9. The second portion 502 preferably comprises a contact part 502*a*. This contact part 502*a* extends substantially parallel to the secondary axis 500*a*, but it may have at least a curvature on its surface, and is directed toward the tooth 501*a* and protruding within the aperture 520.

Preferably the contact part 502 is substantially counter-shaped with respect to the tooth 501*a*.

This contact part 502*a* is therefore preferably suitable to adhere to the tooth 501*a* when the slider is moved toward the aforesaid tooth 501*a*.

The auxiliary element therefore defines an open scissors-like configuration when the contact part 502*a* is far away from the tooth 501*a*, and a closed configuration when the tooth 501*a* adheres to the said contact part 502*a*.

When the element 500 is in the closed configuration the aperture 520 is closed.

Also the second portion 502 is therefore suitable to reduce by its movement the size of the aperture 520.

In greater detail, the portions 501, 502 are suitable to curl the eyelashes of a user when the aperture 520 is closed.

Preferably, the contact part 502*a* has features similar to the contact part 51*a* and the tooth 501*a* has features similar to the tooth 50*a*.

The first portion 501 and the second portion 502 may both therefore comprise a primary movable portion 530 and a secondary movable portion 531, respectively.

The primary movable portion 530 is movably fastened to the first portion 501 and is in particular suitable to control the movement of the first portion 501.

In detail, the primary movable portion 530 is adapted to rotate about an axis that is preferably parallel to the secondary axis 5*a* and is substantially a gripping portion for the user.

In fact, by rotating the primary movable portion 530, the user allows for having a better grip with the fingers in order to use the auxiliary element 500 in the scissors-like configuration.

The secondary movable portion 531 is also preferably movably fastened to the second portion 502 by means of hinges substantially parallel to the secondary axis 500*a*.

Therefore, the secondary movable portion 531 is a gripping point for the user just like the primary movable portion 530.

In addition to the previous description, the auxiliary element 500 preferably comprises at least one extractable component 503.

More appropriately the auxiliary element 500 includes two extractable components 503.

Preferably, the extractable components 503 are doors, each door is adapted to rotate with respect to an axis parallel to the secondary axis 500*a*. In particular, the axes of rotation of the extractable components 503 are arranged so as to enable the extractable components 503 to open or close in correspondence of the portions 501, 502.

The extractable components 503 may be doors with polymer or metal material, or preferably are door frames, i.e. profiles shaped like doors.

The extractable components 503 are, in details, adapted to be laid on the facial skin surface of a user so as to properly align the user's eyelashes with the portions 501, 502.

The operation of the packaging 1 previously described in structural terms is the following.

The packaging for cosmetics 1 enables the canonical use of the cosmetic by a user, i.e. it allows a user to grasp the second container body 3 and to extract the central body 4 from the first container body 2.

In particular, the user can grip the second container body 3 by the cover 30 and, by rotating, can disengage the second container body 3 from the first container body 2. This is possible thanks to the first and second fastening means 21*a*, 43 which are facing in the closed configuration.

In this way the user can apply the cosmetic to their face or to other areas of the body with the aid of the applicator 42.

In addition, the packaging 1 allows the cover 30 to be removed from the second container body 3.

On its removal, the central body 4 remains fastened to the first container body 2 while the auxiliary element 5 emerges.

The user can then grip the packaging 1 by the reservoir 20 and, after having inserted the eyelashes in the slit 52, 520 and, in the case of the preferred solution, having overcome the force of attraction between the first and second tightening elements 54, 55, can rotate the secondary movable portion 53, or rotate and hence grip the primary and secondary movable portions 530, 531, in such a way as to guide the second portion 51, 502 towards the tooth 50*a*, 501*a* of the first portion 50, 501.

Once the eyelashes are closed between the contact part 51*a*, 502*a* and the tooth 50*a*, 501*a*, the eyelashes are curled and the auxiliary element has fulfilled the function of an eyelash curler.

The packaging for cosmetics 1 according to the invention delivers significant advantages.

Indeed, the packaging for cosmetics 1 encompasses, in a single device, components that enable the performance of various functions related to the beautification of the face or other.

Another significant advantage arises from the fact that despite the packaging 1 including components intended for different types of uses, the dimensions of the packaging 1 itself are compact and do not cause bulkiness of dimensions substantially increased with respect to conventional casings.

For this reason, the packaging 1 is also aesthetically in line with typical requirements in connection with the make-up market.

Finally, a further advantage arises from the fact that the multi-functionality of the packaging 1 ensures that a user can benefit from the functionality of the components at a much lower cost than for example purchasing the individual components separately which would also, as already stated, make it bulkier.

The invention is subject to variations falling within the scope of the inventive concept as defined by the claims.

In this context all the details are replaceable by equivalent elements and the materials, shapes and dimensions can be any.

The invention claimed is:

1. A packaging for cosmetics defining a longitudinal axis and a normal plane perpendicular to said longitudinal axis comprising:

a first container body, a removable second container body, a central body comprising a base and an applicator, said first container body being configured to be coupled to said second container body, defining a closed configuration, defining an internal volume of said packaging, and an open configuration for said packaging, said central body being detachably fastened to and partially arranged within one of said container bodies and being also partially arranged inside the other of said container bodies when said packaging is in the closed configuration, said first container body comprising a first fastening means and said second container body housing a second fastening means, said first fastening means and said second fastening means being configured to couple said first container body and said second container body, said packaging comprising an auxiliary element, separated from said applicator, said auxiliary element comprising a first portion and a second portion, said first portion and said second portion defining between them at least one aperture, said at least one aperture being configured to accommodate eyelashes, said second portion being movably fastened to said first portion and configured to reduce by its movement the size of said aperture, and said first portion and said second portion being configured to curl said eyelashes when said aperture is closed, said auxiliary element being includible within said second container body, said second portion being a slider that is suitable to translate along said longitudinal axis with respect to said first portion, said auxiliary element comprising a secondary movable portion, said secondary movable portion being movably fastened just to said first portion and being suitable to control the movement of said second portion.

2. The packaging according to claim 1, wherein said auxiliary element defines a secondary axis, said secondary axis being parallel to said normal plane, and said secondary movable portion is a class 1 lever configured to rotate around said secondary axis.

3. The packaging according to claim 2, in which the first portion comprises a tooth, said tooth extending transversely with respect to said secondary axis, protruding toward said aperture, and being configured to adhere to the outer surface of said second portion when said aperture is closed.

4. The packaging according to claim 1, in which said first portion comprises a first tightening element and said secondary movable portion comprises a second tightening element, said tightening elements being configured to detachably fasten at least part of said first portion and at least part of said secondary movable portion.

5. The packaging according to claim 1, wherein at least said first portion and said second portion define a scissors-like structure.

6. The packaging according to claim 1, in which the said first portion comprises a tooth, said tooth extending along said longitudinal axis inside said aperture and being configured to adhere to the outer surface of said second portion when said aperture is closed.

7. The packaging according to claim 6, wherein said second portion comprises a contact part, said contact part being configured to adhere to said tooth when said aperture is closed and being formed of material having a hardness lesser than that of said tooth.

8. The packaging according to claim 1, wherein the auxiliary element comprises two extractable components, said extractable components being configured to be lying on the facial skin surface of a user to tell so that to properly align the user eyelashes with said first portion and said second portion.

9. The packaging according to claim 1, wherein said removable second container body is configured to make said auxiliary element emerge.

10. The packaging according to claim 1, wherein said auxiliary element is fastened to said base of said central body.

* * * * *